US006990950B2

(12) United States Patent
Asano et al.

(10) Patent No.: US 6,990,950 B2
(45) Date of Patent: Jan. 31, 2006

(54) FUEL INJECTION SYSTEM OF INTERNAL COMBUSTION ENGINE

(75) Inventors: Masahiro Asano, Kariya (JP); Yoshihiro Narahara, Kariya (JP); Eiji Takemoto, Obu (JP); Akira Umehara, Kariya (JP)

(73) Assignee: Denso Corporation, Kariya (JP)

( * ) Notice: Subject to any disclaimer, the term of this patent is extended or adjusted under 35 U.S.C. 154(b) by 72 days.

(21) Appl. No.: 10/873,144

(22) Filed: Jun. 23, 2004

(65) Prior Publication Data

US 2004/0267434 A1 Dec. 30, 2004

(30) Foreign Application Priority Data

Jun. 27, 2003 (JP) ..... 2003-185907

(51) Int. Cl.
*F02B 3/00* (2006.01)

(52) U.S. Cl. ..... 123/299; 123/674

(58) Field of Classification Search ..... 123/674, 123/294, 299, 305, 395, 339.12, 445, 480
See application file for complete search history.

(56) References Cited

U.S. PATENT DOCUMENTS 4,729,359 A * 3/1988 Tomisawa et al. ..... 123/339.12
4,977,881 A * 12/1990 Abe et al. ..... 123/674
5,483,945 A * 1/1996 Kobayashi et al. ..... 123/374
6,755,176 B2 * 6/2004 Takeuchi et al. ..... 123/299

FOREIGN PATENT DOCUMENTS

JP 10-205372 8/1998

* cited by examiner

*Primary Examiner*—Bibhu Mohanty
(74) *Attorney, Agent, or Firm*—Nixon & Vanderhye P.C.

(57) ABSTRACT

An electronic control unit (an ECU) of a fuel injection system performs a learning injection based on a learning injection quantity and obtains multiple influence values of an operating state of an engine generated through the learning injection. The ECU calculates a learning value for correcting the injection quantity in a normal operation based on the multiple influence values. The ECU determines whether the influence value obtained during the learning injection is within a predetermined range of the influence value. The ECU calculates a provisional learning injection quantity for bringing a subsequent influence value into the predetermined range if the influence value obtained in an early stage of the obtainment is out of the predetermined range. Then, the ECU calculates the other influence values by performing the other learning injections based on the provisional learning injection quantity.

7 Claims, 7 Drawing Sheets

FUEL INJECTION SYSTEM OF INTERNAL COMBUSTION ENGINE

CROSS REFERENCE TO RELATED APPLICATION

This application is based on and incorporates herein by reference Japanese Patent Application No. 2003-185907 filed on Jun. 27, 2003.

BACKGROUND OF THE INVENTION

1. Field of the Invention

The present invention relates to a fuel injection system. Specifically, the present invention relates to a fuel injection system for automatically correcting a deviation in an injection quantity, which is caused by a change with time and the like, by performing learning control.

2. Description of Related Art

In recent years, in accordance with reinforcement of exhaust gas limitation, higher and higher accuracy has been required in an injection quantity of fuel injection. For instance, in recent years, a diesel engine is required to perform a pilot injection, multi-step injection and the like because of the reinforcement of the exhaust gas limitation. Therefore, the accuracy in the injection quantity has to be improved.

In order to achieve the high injection accuracy, minute adjustment of a fuel injection device or the like can be performed before shipment. However, even if the minute adjustment is performed, there is a possibility that the injection quantity changes because of a change with time. In this case, there is a possibility that the high injection accuracy cannot be maintained.

Learning control is known as one of countermeasures against the above problem. In the learning control, a learning injection is performed during an operation of the engine, and a deviation between a learning injection quantity (an injection quantity calculated by a control device) and an actual injection quantity (an actually injected quantity) is calculated. Then, a learning value (a correction value) is calculated from the deviation and the injection quantity during a normal operation is corrected based on the learning value so that an injection quantity (an aimed injection quantity) calculated in accordance with an operating state of the engine coincides with the actual injection quantity.

For instance, in conventional learning control disclosed in Unexamined Japanese Patent Application Publication No. H10-205372, the learning injection (for instance, a small-amount injection) is performed if the operating state of the engine becomes a learning operating state. Then, multiple influence values representing the influence of the learning injection are obtained. The influence values are calculated from a change in the operating state of the engine (for instance, a change in rotation speed sensed by a rotation speed sensor). After the multiple influence values are obtained, a learning value for correcting the injection quantity during the normal operation is calculated based on an average of the obtained influence values.

In the conventional learning control, if the learning condition is established, the learning injection quantity (a learning master injection quantity) of the fuel is injected. The learning master injection quantity is an injection quantity suitable for the learning.

Therefore, if the learning master injection quantity of the fuel is injected in a state in which the injection accuracy is reduced because of the change with time and the like, there is a possibility that an engine operating state characteristic value (for instance, exhaust emission, engine noise or torque generated by the engine) becomes inappropriate.

SUMMARY OF THE INVENTION

It is therefore an object of the present invention to provide a fuel injection system capable of maintaining high injection accuracy for a long time by performing learning control and of preventing an engine operating state characteristic value from becoming inappropriate because of influence of the learning injection.

According to an aspect of the present invention, a fuel injection system includes a control unit, which performs a learning injection for injecting a learning injection quantity of fuel and obtains multiple influence values of an operating state of an engine, which are generated by the learning injection. The control unit calculates a learning value for correcting the injection quantity in a normal operation based on the multiple influence values. The control unit includes determining means for determining whether the influence value obtained during the learning injection is within a predetermined range of the influence value, which is set in accordance with a characteristic value of the operating state of the engine. The control unit calculates a provisional learning injection quantity for bringing a subsequent influence value into the predetermined range if the influence value obtained in an early stage of the obtainment of the influence values is out of the predetermined range. Then, the control unit calculates the other influence values by performing the other learning injections based on the provisional learning injection quantity.

Through the above control, the engine operating state characteristic value can be prevented from staying in an undesirable state throughout a learning period.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF THE REFERRED EMBODIMENTS (First Embodiment)

Figure 1:
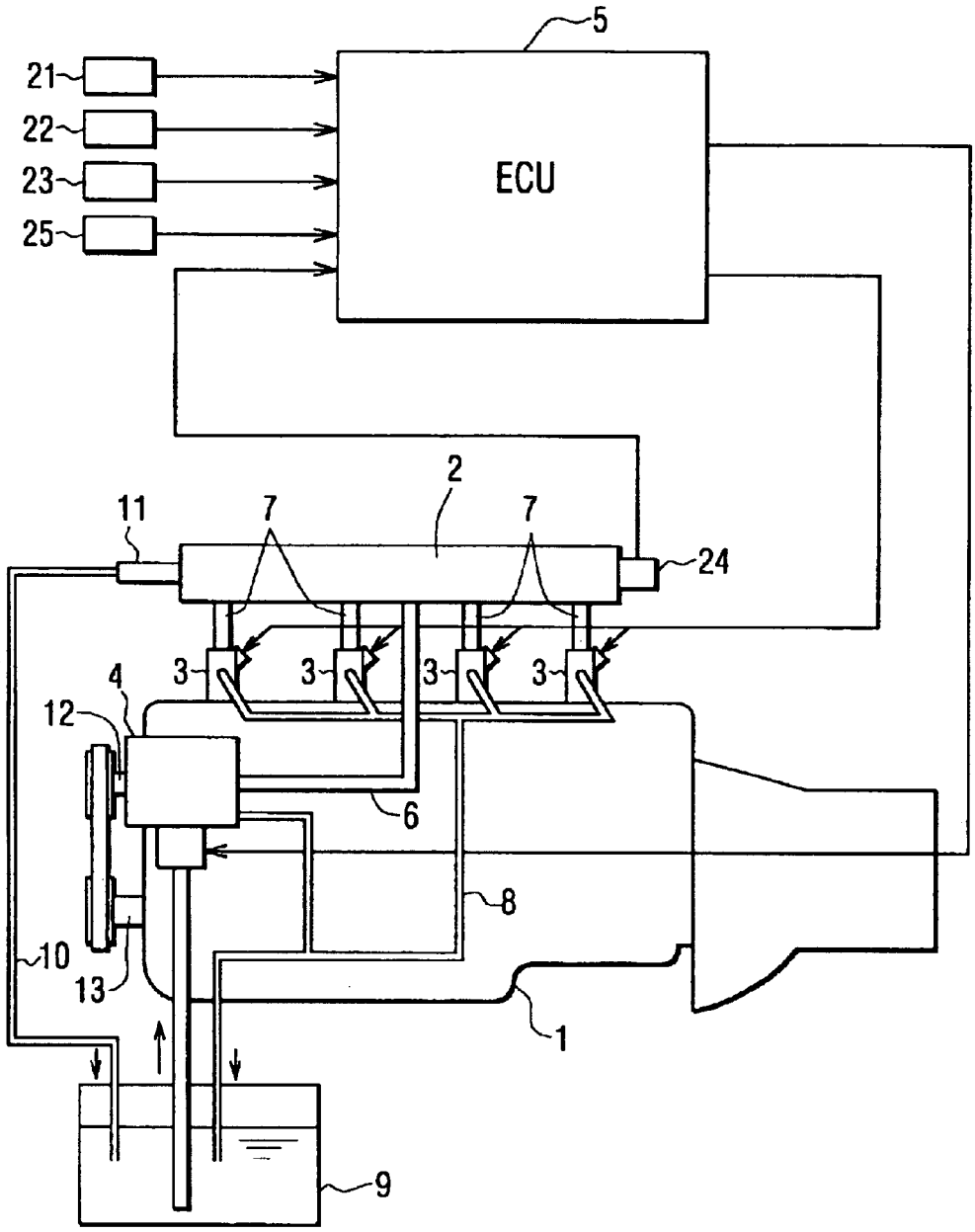
FIG. 1 is a schematic diagram showing an entire structure of a fuel injection system according to a first embodiment of the present invention.

Referring to FIG. 1, a common rail type fuel injection system according to a first embodiment of the present invention is illustrated. The common rail type fuel injection system performs fuel injection into respective cylinders of an engine (for instance, a diesel engine) 1. As shown in FIG. 1, the fuel injection system includes a common rail 2, injectors 3, a supply pump 4, an engine control unit (an ECU) 5 and the like.

The common rail 2 is a pressure accumulation vessel for accumulating high-pressure fuel, which is supplied to the injectors 3. The common rail 2 is connected to a discharge hole of the supply pump 4, which pressure-feeds the high-pressure fuel, through a high-pressure pump pipe 6 so that a common rail pressure corresponding to a fuel injection pressure is accumulated in the common rail 2. Meanwhile, the common rail 2 is connected with multiple injector pipes 7, which supply the high-pressure fuel into the respective injectors 3. Leak fuel from the injectors 3 and the supply pump 4 is returned to a fuel tank 9 through a leak pipe 8.

A pressure limiter 11 is attached to a relief pipe 10, which returns the fuel from the common rail 2 to the fuel tank 9. The pressure limiter 11 is a pressure safety valve, which opens when the fuel pressure in the common rail (the common rail pressure) exceeds a limit set pressure in order to limit the common rail pressure below the limit set pressure.

A pressure reducing valve is attached to the common rail 2. The pressure reducing valve opens responsive to a valve opening command signal provided by the ECU 5 to make the high-pressure fuel in the common rail 2 overflow through the leak pipe 8 so that the common rail pressure is reduced quickly. Thus, by mounting the pressure reducing valve to the common rail 2, the ECU 5 can perform control for quickly reducing the common rail pressure to a pressure corresponding to a traveling state of a vehicle.

The injectors 3 are mounted on the respective cylinders of the engine 1 and supply the fuel into the respective cylinders through injection. Each injector 3 includes a fuel injection nozzle, an electromagnetic valve and the like. The fuel injection nozzle is connected to a downstream end of one of the injector pipes 7 branching from the common rail 2 and supplies the high-pressure fuel accumulated in the common rail 2 into each cylinder through the injection. The electromagnetic valve controls a lifting degree of a needle accommodated inside the fuel injection nozzle.

The supply pump 4 pressure-feeds the fuel, which is pressurized to a high pressure, into the common rail 2. The supply pump 4 includes a feed pump and a high-pressure pump. The feed pump draws the fuel from the fuel tank 9. The high-pressure pump pressure-feeds the fuel, of which pressure is controlled by a regulator valve and of which quantity is regulated by a fuel flow control valve (a suction control valve), into the common rail 2. The feed pump and the high-pressure pump are driven by a camshaft 12 to rotate. The camshaft 12 is driven by a crankshaft 13 of the engine 1 to rotate.

The ECU 5 is a computer including a CPU, a memory device (RAM, ROM, backup RAM and the like), an A/D converter, an input port, an output port and the like.

The ECU 5 is connected with various sensors for obtaining information signals (signals for sensing an operating state of the engine 1 or the vehicle) used in calculation. More specifically, the ECU 5 is connected with a rotation speed sensor 21 for sensing engine rotation speed Ne, a throttle opening degree sensor 22 for sensing an opening degree of a throttle disposed inside an air intake pipe, a cooling water temperature sensor 23 for sensing engine cooling water temperature Thw, a common rail pressure sensor 24 for sensing the common rail pressure Pcr, and other sensors 25.

The ECU 5 performs injection control during a normal operation and performs learning control. The ECU 5 determines a target injection quantity, an injection mode (a multi-injection including a pilot injection, a single injection or the like), valve opening timing and valve closing timing of the injector 3 and the like for each cylinder and for each injection, based on programs stored in the ROM, the signals of the various sensors (the operating state of the vehicle) inputted into the RAM, a correction value written into the backup RAM (for instance, a nonvolatile memory) and the like.

The ROM mounted inside the ECU 5 is programmed with a learning control program in advance for learning and correcting the deviation in the injection quantity of each cylinder. The deviation in the injection quantity is generated by a change in the injector 3 with time, for instance. In the present embodiment, correction based on the engine cooling water temperature Thw and correction control based on an individual difference of the electromagnetic valve of the injector 3 are not explained for the sake of easy comprehension of the embodiment of the present invention.

In the learning control program, the injector 3 is commanded to inject a learning injection quantity of the fuel (a small quantity of the fuel corresponding to an injection quantity of the pilot injection) into the cylinder as an object of the correction if a learning condition is established during the operation of the engine 1. Then, multiple (for instance, ten) influence values generated through the learning injection are obtained and a learning value (a correction value) of the cylinder is calculated based on the obtained influence values. The learning value is stored in the backup RAM mounted in the ECU 5.

The ECU 5 determines the injection quantity (an injection period TQ) during the normal operation in accordance with the learning value of each cylinder stored in the backup RAM. More specifically, the ECU 5 performs the correction control of the opening timing and closing timing of the electromagnetic valve of the injector 3 (or the injection period TQ) with the use of the learning value so that the calculated injection quantity (the aimed injection quantity corresponding to the operating state) coincides with the actual injection quantity.

As explained above, the ECU 5 performs the learning injection and obtains the multiple (ten) influence values generated through the learning injection, and calculates the learning value based on the obtained influence values.

In the present embodiment, the actual injection quantity is employed as the influence value of the learning injection for the sake of easy comprehension of the embodiment. In the present embodiment, the torque generated by the engine 1

(the generated torque) is calculated from a variation (ΔNe) in the engine rotation speed Ne, and the actual injection quantity is calculated from the calculated generated torque.

Alternatively, the learning value may be calculated by obtaining other multiple influence values influenced by the learning injection (or influence values having tangible relationships with the actual injection quantity) such as the engine rotation speed variation ΔNe, the generated torque, or an air-fuel ratio.

The ECU 5 includes learning range determining means and learning injection quantity correcting means. The learning range determining means determines whether the influence value obtained during the learning injection exists in a predetermined range of the influence value set based on a characteristic value of the operating state of the engine. The learning injection quantity correcting means calculates a provisional learning injection quantity, which brings the influence value into the predetermined range, when the influence value is out of the predetermined range in the early stage of the obtainment of the influence values (when the first influence value is obtained, in the present embodiment). Then, the learning injection quantity correcting means performs the other learning injections based on the provisional learning injection quantity and corrects the injection quantities of the learning injections performed to obtain the other influence values.

In the present embodiment, the predetermined range of the influence value is set in accordance with a quantity of the exhaust emission, the engine noise and the generated torque.

Figure 3:
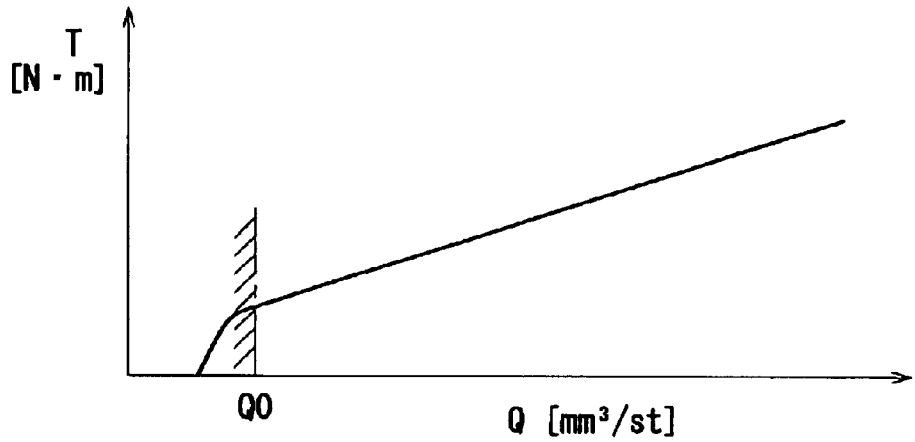
FIG. 3 is a graph showing a relationship between an injection quantity and generated torque according to the first embodiment.

As shown in FIG. 3, in the diesel engine, the actual injection quantity Q is basically proportional to the generated torque T. However, in the case where the injection quantity Q is too small (in the case where the injection quantity Q is less than a predetermined injection quantity Q0), the proportional relationship is broken as shown in FIG. 3.

As explained above, in the present embodiment, the generated torque T is calculated and the actual injection quantity Q is calculated from the generated torque T. Therefore, the appropriate learning can be performed only in the range where the proportional relationship between the actual injection quantity Q and the generated torque T is established. More specifically, the learning injection quantity has to be set above the predetermined injection quantity Q0 shown in FIG. 3.

Figure 4:
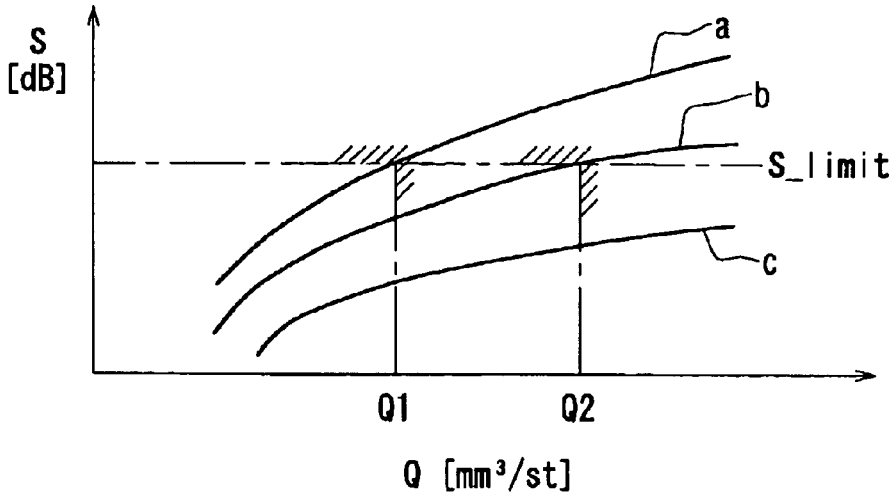
FIG. 4 is a graph showing a relationship between the injection quantity and a noise level with respect to a common rail pressure according to the first embodiment.

In the common rail type fuel injection system, as shown in FIG. 4, the engine noise S increases as the actual injection quantity Q increases or as the common rail pressure Pcr increases. In FIG. 4, a solid line "a" represents the relationship between the actual injection quantity Q and the noise level S at the time when the common rail pressure Pcr is 120 MPa, and another solid line "b" represents the relationship at the time when the common rail pressure Pcr is 80 MPa, and the other solid line "c" represents the relationship at the time when the common rail pressure Pcr is 40 MPa. The noise level S of the engine 1 changes if the engine operating state such as the engine rotation speed Ne changes.

Therefore, in the case where a permissible limit of the noise level S (a noise permissible limit) for preventing vehicle occupants from being bothered is set, the learning injection quantity providing the engine noise level S below the noise permissible limit can be determined in accordance with the engine operating state of the moment such as the common rail pressure Pcr or the engine rotation speed Ne.

More specifically, in the case where the noise permissible limit is set as shown by a chained line S_limit in FIG. 4, the learning injection quantity has to be set below a predetermined injection quantity Q1 when the common rail pressure is 120 MPa, or the learning injection quantity has to be set below another predetermined injection quantity Q2 when the common rail pressure is 80 MPa.

The quantity of the exhaust emission (an emission quantity E) is changed in accordance with the engine operating state such as the actual injection quantity Q, the common rail pressure Pcr or the engine rotation speed Ne. Therefore, in the case where a permissible limit of the emission quantity E (an emission quantity permissible limit) is set, the learning injection quantity providing the emission quantity E lower than the emission quantity permissible limit can be determined in accordance with the engine operating state of the moment such as the common rail pressure Pcr or the engine rotation speed Ne.

Figure 5A:
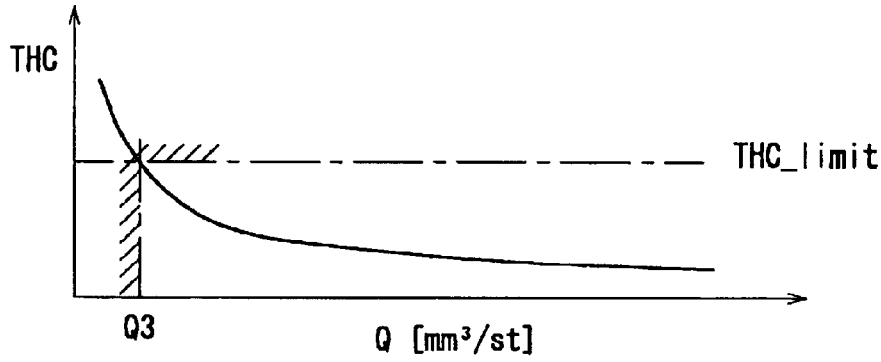
FIG. 5A is a graph showing a relationship between the injection quantity and a THC emission quantity according to the first embodiment.

More specifically, a quantity of the emission of total hydrocarbons (THC) increases as the actual injection quantity Q decreases as shown in FIG. 5A. Therefore, in the case where the emission quantity permissible limit of the THC is set as shown by a chained line THC_limit in FIG. 5A, the learning injection quantity has to be set above a predetermined injection quantity Q3.

Figure 5B:
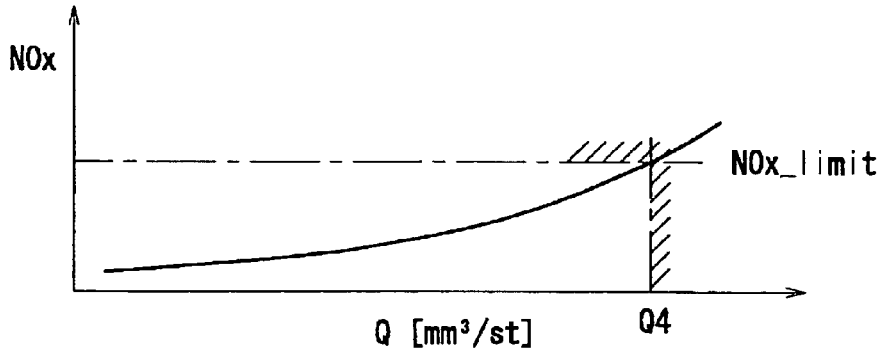
FIG. 5B is a graph showing a relationship between the injection quantity and a NOx emission quantity according to the first embodiment.

A quantity of the emission of nitrogen oxides (NOx) increases as the actual injection quantity Q increases as shown in FIG. 5B. Therefore, in the case where the emission quantity permissible limit of the nitrogen oxides is set as shown by a chained line NOx_limit in FIG. 5B, the learning injection quantity Q has to be set below a predetermined injection quantity Q4.

The generated torque T of the engine 1 changes if the injection quantity Q changes. Even if the injection quantity Q is constant, the generated torque T changes in accordance with start timing of the injection. A change in the generated torque T in the case where the injection quantity Q is held at a constant value but the injection start timing θ is varied is shown in FIG. 6.

Figure 6:
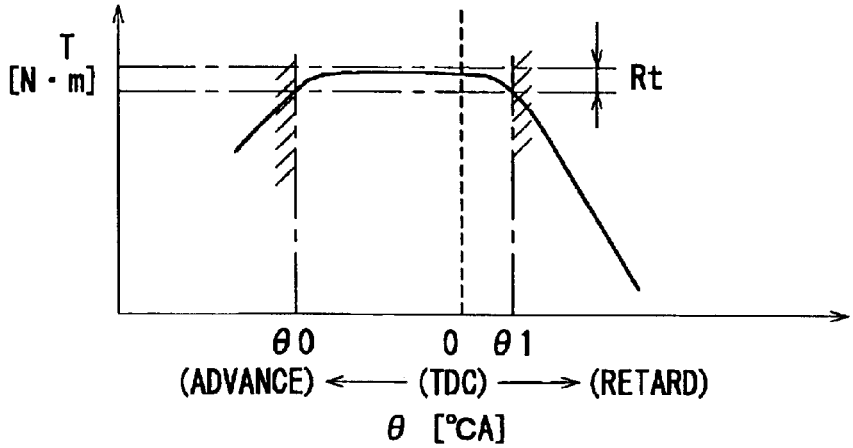
FIG. 6 is a graph showing a relationship between injection start timing and the generated torque according to the first embodiment.

As shown in FIG. 6, if the injection start timing θ is advanced excessively, loss is caused by ignition of the fuel at timing before a top dead center (TDC). As a result, only a part of the generated torque T is used to rotate the engine 1. To the contrary, if the injection start timing θ is retarded excessively, ignition failure is caused or the injected fuel is not combusted sufficiently. As a result, the generated torque T is reduced.

In order to prevent the fluctuation of the generated torque T when the injection quantity Q is constant, the injection start timing θ has to be set within a certain range.

More specifically, the generated torque T fluctuates if the injection start timing θ is advanced before timing $\theta_0$ or is retarded after timing $\theta_1$ shown in FIG. 6. A range Rt in FIG. 6 represents a permissible range of the fluctuation of the generated torque T. Therefore, the injection start timing θ has to be set in the range between the timing $\theta_0$ and the timing $\theta_1$.

The permissible range of the injection start timing θ may be determined in accordance with the engine noise level S or the emission quantity E.

Next, an example of the learning control performed by the ECU 5 will be explained based on a flowchart shown in FIG. 7.

Figure 7:
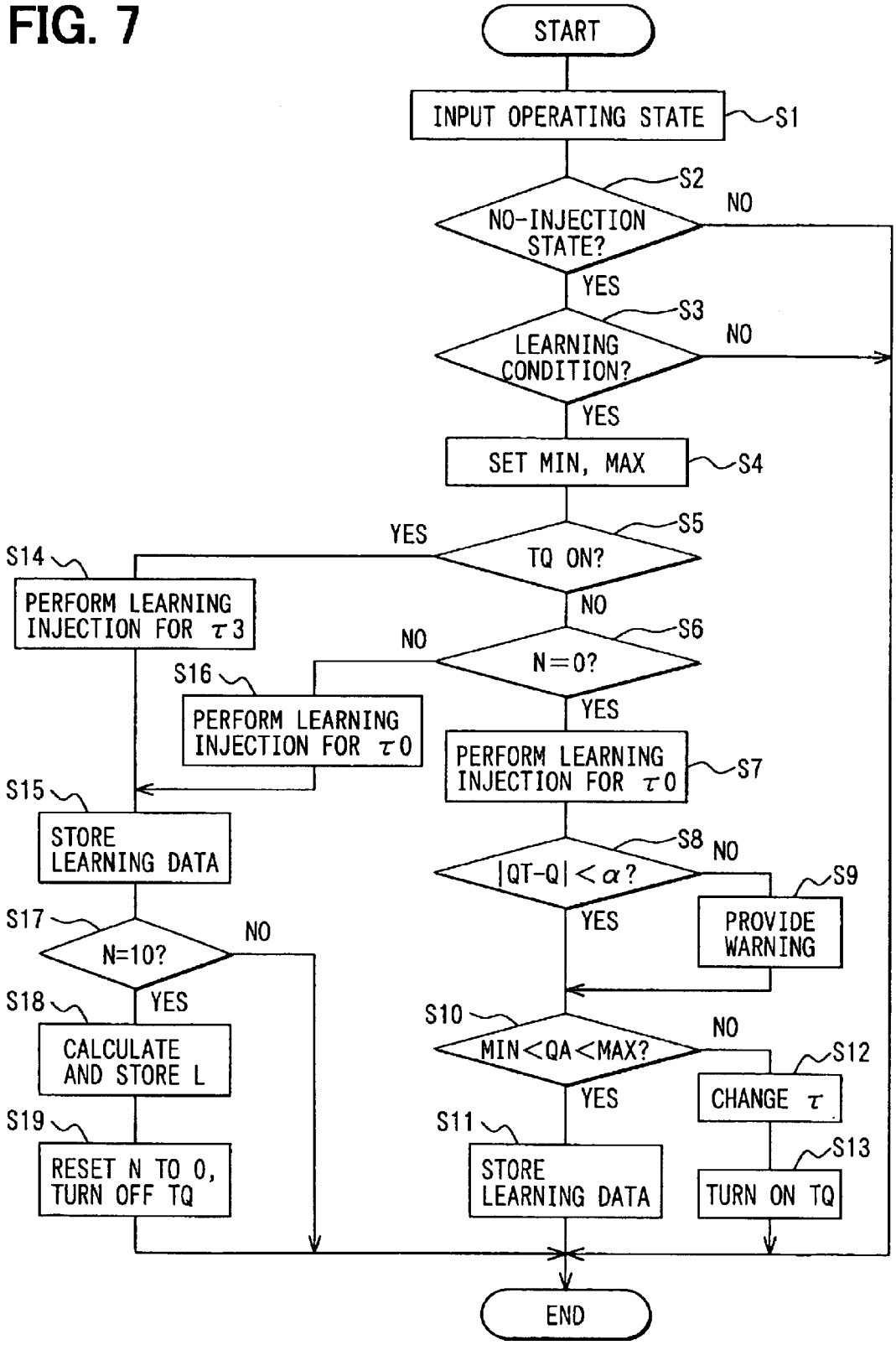
FIG. 7 is a flowchart of learning control according to the first embodiment.

If the control routine shown in FIG. 7 is started during the operation of the engine 1, values sensed by the various sensors representing a present operating state-of the engine 1 are inputted in Step S1.

Then, in Step S2, it is determined whether the engine 1 is in a no-injection state, in which the fuel supply to the engine 1 is suspended.

If the result of the determination in Step S2 is "NO", the routine is ended without performing determination of a learning condition. If the result of the determination in Step S2 is "YES", it is determined whether a predetermined learning condition is established in Step S3.

The predetermined learning condition of the present embodiment is established, when the engine rotation speed Ne is higher than a predetermined rotation speed, when the engine cooling water temperature Thw is higher than a predetermined temperature, when the common rail pressure is within a predetermined pressure range, and when the throttle disposed in the air intake pipe is fully opened.

If the result of the determination in Step S3 is "NO", the routine is ended. If the result of the determination in Step S3 is "YES", a lower threshold value MIN and a higher threshold value MAX of a range of the learning injection quantity (a learning injection quantity range) are set in Step S4. The learning injection quantity range corresponds to a predetermined range of the influence value set based on a characteristic value of the operating state of the engine 1 (an engine operating state characteristic value) such as the emission quantity, the engine noise or the generated torque, which is generated through the influence of the learning injection. The threshold values MIN, MAX are set so that the engine operating state characteristic value generated by the learning injection falls within a predetermined operating range when the learning injection quantity is between the threshold values MIN, MAX.

Figure 8:
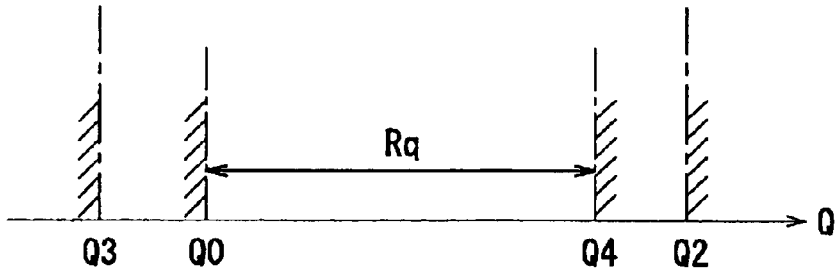
FIG. 8 is a diagram showing a learning injection quantity range according to the first embodiment.
Figure 10:
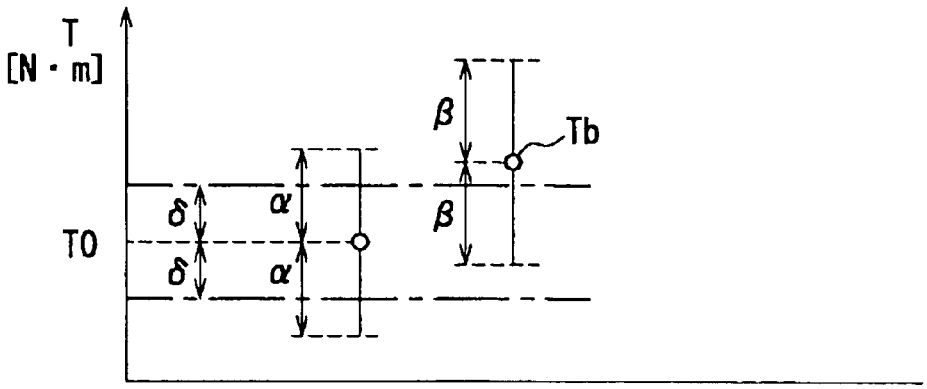
FIG. 10 is a graph showing degradation determination of an injection system of a modified example of the first embodiment.

More specifically, as shown in FIG. 8, the lower threshold value MIN of the learning injection quantity range is set greater than both of a predetermined injection quantity Q0 and a predetermined injection quantity Q3. The higher threshold value MAX of the learning injection quantity range is set less than both of a predetermined injection quantity Q2 and a predetermined injection quantity Q4. The generated torque T becomes greater than a predetermined value Tmin when the injection quantity Q is greater than the predetermined injection quantity Q0. The noise level S becomes less than a predetermined value Smax when the injection quantity Q, which is determined by the common rail pressure, is less than the predetermined injection quantity Q2 in the case where the common rail pressure is 80 MPa, for instance. The total hydrocarbon emission quantity (THC) becomes less than a permissible limit when the injection quantity Q is greater than the predetermined injection quantity Q3. The nitrogen oxide emission quantity (NOx) becomes less than a permissible limit when the injection quantity Q is less than the predetermined injection quantity Q4. In FIG. 8, the learning injection quantity range Rq extends from the predetermined injection quantity Q0 to the predetermined injection quantity Q4.

Then, in Step S5, it is determined whether a TQ changing flag (TQ) is on. The TQ changing flag is turned on if the learning injection quantity is changed so that the engine operating state characteristic value, which is generated by the influence of the learning injection, falls within the predetermined range when the engine operating state characteristic value is out of the predetermined range.

If the result of the determination in Step S5 is "NO", it is determined whether the number of the influence value in the data obtained through the learning is zero in Step S6.

Figure 2:
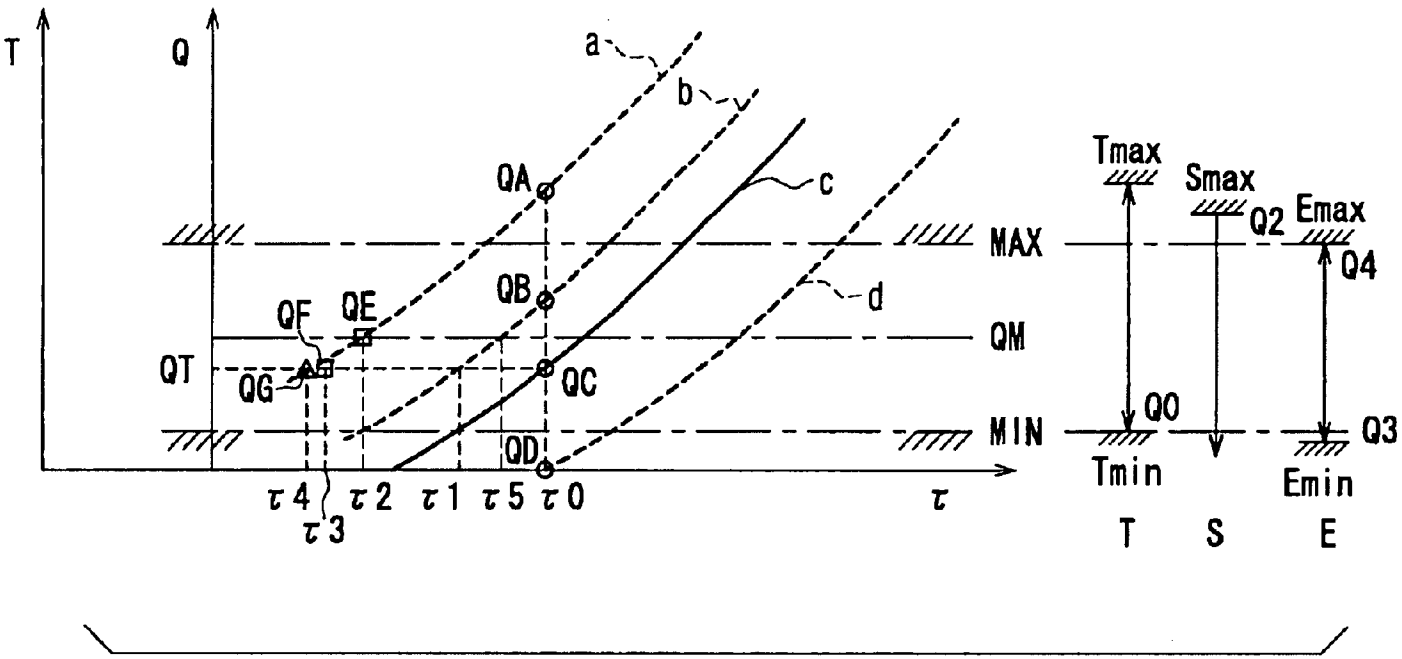
FIG. 2 is a graph showing a TQ-Q characteristic according to the first embodiment.

If the result of the determination in Step S6 is "YES", a learning master injection quantity QC of the fuel is injected in Step S7 as shown in FIG. 2. The learning master injection quantity QC is a basic injection quantity suitable for the learning injection. In Step S7, an injection period $\tau 0$ (an initial value) for obtaining the learning master injection quantity QC is calculated from a master TQ-Q characteristic shown by a solid line "c" in FIG. 2, and the learning injection is performed for the period $\tau 0$. The master TQ-Q characteristic is a relational expression between the injection period $\tau$ and the injection quantity Q at the time when the performance degradation is not caused. The start timing of the learning injection is set between the timing $\theta_0$ and the timing $\theta_1$.

Then, in Step S8, the actual injection quantity Q is calculated from the generated torque T generated by performing the learning injection, and it is determined whether the actual injection quantity Q is within a predetermined range with respect to the learning master injection quantity QC (an aimed injection quantity QT).

In Step S8, it is determined whether the performance degradation of an injection system such as the injector 3 is within an anticipated range. The anticipated range used in Step S8 is set wider than the learning injection quantity range defined by the threshold values MIN, MAX.

If the result of the determination in Step S8 is "NO", the degradation in the injection system is warned to a vehicle driver and the like through visual displaying means such as a lamp in Step S9.

If the result of the determination in Step S8 is "YES", it is determined whether the actual injection quantity Q calculated from the generated torque T is within the learning injection quantity range defined by the threshold values MIN, MAX in Step S10.

If the result of the determination in Step S10 is "YES" (for instance, when the actual injection quantity Q is a quantity QB between the threshold values MIN, MAX as shown in FIG. 2), the actual injection quantity Q calculated from the generated torque T is stored as the data for the learning in Step S11, and the routine is ended.

If the result of the determination in Step S10 is "NO" (for instance, when the actual injection quantity is a quantity QA or a quantity QD, which is out of the learning injection quantity range as shown in FIG. 2), a provisional learning injection quantity for conforming the actual injection quantity Q to the learning master injection quantity QC is calculated in Step S12.

Next, a specific example of changing the injection quantity will be explained.

If the TQ-Q characteristic shown by the solid line "c" in FIG. 2 is degraded, the TQ-Q characteristic is changed to a characteristic shown by one of broken lines "a", "b", "d" in FIG. 2 in parallel with the initial characteristic shown by the solid line "c". Therefore, in the case where the actual injection quantity Q is the quantity QA, an injection period $\tau 3$ used in the calculation of the provisional injection quantity is calculated from the TQ-Q characteristic shown by the broken line "a", which provides the injection quantity QA when the injection period $\tau$ is the period $\tau 0$, and from an injection quantity QF shown in FIG. 2.

Then, the TQ changing flag (TQ), which represents the fact that the injection period $\tau$ of the learning injection is changed, is turned on in Step S13, and the routine is ended.

Through the above control, the injection quantity Q is changed to the learning injection quantity (the injection period) suitable for the learning, while the number of the value included in the learning data is one or zero.

Therefore, if the control routine shown in FIG. 7 is started next time, the determination in Step S5 is affirmatively determined (YES) or the determination in Step S6 is negatively determined (NO).

If the result of the determination in Step S5 is "YES", the learning injection is performed in Step S14 for the injection period (for instance, the period $\tau$3), which is changed in Step S12. Then, in Step S15, the actual injection quantity Q calculated from the generated torque T is stored as the learning data for the learning.

If the result of the determination in Step S6 is "NO", the learning injection is performed for the injection period $\tau$0 (the initial value) in Step S16 without changing the injection period $\tau$0, because the initially set learning injection quantity is between the threshold values MIN, MAX. Subsequently, the actual injection quantity calculated from the generated torque is stored as the learning data for the learning in Step S15.

Then, it is determined whether the number of values included in the data stored in Step S11 or Step S15 reaches a predetermined number (for instance, ten) in Step S17.

If the result of the determination in Step S17 is "NO", the routine is ended.

If the result of the determination in Step S17 is "YES", the deviation between the ten values included in the learning data (the actual injection quantities) and the learning master injection quantity are calculated. Then, the learning value (the correction value) L is calculated from the deviations, and the learning value L is stored in the memory device such as the backup RAM in Step S18.

During the normal operation, the injection quantity (the injection period) is corrected based on the learning value L stored in the memory device. More specifically, in the case where the ECU 5 calculates the injection quantity QG corresponding to the operating state of the engine 1 during the normal operation as shown in FIG. 2, an injection period $\tau$4 is calculated in accordance with the learning value L stored in the memory device.

Subsequently, the number N of the values included in the learning data is reset to zero, and the TQ changing flag (TQ) is turned off in Step S19, and the routine is ended.

The above learning control is performed sequentially for each cylinder.

The fuel injection system of the present embodiment calculates the provisional learning injection quantity (the injection period) for substantially conforming the actual injection quantity (the influence value) to the learning master injection quantity when the actual injection quantity (the influence value) obtained in the early stage is out of the predetermined range. Then, the other learning injections are performed based on the provisional learning injection quantity to obtain the other actual injection quantities (the other influence values), which are used in the learning. This control can prevent the engine operating state characteristic value from remaining in an undesirable state in the entire learning period.

When the actual injection quantity (the influence value) obtained in the early stage is out of the predetermined range, the fuel injection system of the present embodiment substantially conforms the actual injection quantity of the learning injection to the learning master injection quantity suitable for the learning and obtains the other actual injection quantities (the other influence values). Therefore, the actual injection quantities (the influence values) suitable for the learning control can be obtained and the learning accuracy can be improved.

Moreover, the fuel injection system of the present embodiment provides a warning to the vehicle driver when the performance of the injection system such as the injector 3 is degraded largely. Therefore, the travel in the degraded state of the injection performance can be avoided.

(Second Embodiment)

Next, learning control according to a second embodiment of the present invention will be explained.

As explained above, in the first embodiment, the provisional learning injection quantity (the injection period) is calculated to substantially conform the actual injection quantity of the learning injection to the learning master injection quantity only when the actual injection quantity (the influence value) obtained in the early stage is out of the predetermined range.

In contrast, in the second embodiment, even if the actual injection quantity (the influence value) obtained in the early stage is within the predetermined range, the provisional learning injection quantity (the injection period) is calculated so that the actual injection quantity of the learning injection substantially conforms to the learning master injection quantity. Thus, the other actual injection quantities (the other influence values) are obtained by performing the other learning injections based on the provisional learning injection quantity.

More specifically, even in the case where the result of the determination in Step S10 is "YES", the injection period $\tau$ is changed to substantially conform the actual injection quantity Q of the learning injection to the learning master injection quantity QC if the actual injection quantity Q is the quantity QB, which is deviated from the learning master injection quantity QC as shown in FIG. 2.

Next, a specific example of changing the injection quantity will be explained. In the case where the actual injection quantity is the quantity QB as shown in FIG. 2, the injection period $\tau$1 corresponding to the master injection quantity QC is calculated from the TQ-Q characteristic shown by the broken line "b", which provides the quantity QB when the injection period is the period $\tau$0 and is parallel to the TQ-Q characteristic shown by the solid line "c". Then, the other actual injection quantities (the other influence values) are obtained by performing the other learning injections based on the injection period $\tau$1.

Through the above control of the present embodiment, the influence value most suitable for the learning control can be obtained even if the actual injection quantity (the influence value) obtained in the early stage is within the predetermined range. Thus, the learning accuracy can be improved.

(Third Embodiment)

Next, learning control according to a third embodiment of the present invention will be explained.

In the learning control of the first embodiment or the second embodiment, the provisional learning injection quantity (the injection period) is calculated so that the actual injection quantity of the learning injection substantially conforms to the learning master injection quantity.

In contrast, in the learning control according to the third embodiment, a provisional learning injection quantity (an injection period) for substantially conforming the actual injection quantity (the influence value) to a median of the predetermined range is calculated in the case where the actual injection quantity (the influence value) obtained in the early stage is out of the predetermined range. Then, the other actual injection quantities (the other influence values) are obtained by performing the other learning injections based on the provisional learning injection quantity (the injection period).

More specifically, in the case where the actual injection quantity Q is the quantity QA, which is out of the learning injection quantity range defined by the threshold values MIN, MAX as shown in FIG. 2, or in the case where the result of the determination in Step S10 of the first embodiment is "NO", an injection period τ2 is calculated from an injection quantity QE based on the TQ-Q characteristic shown by the broken line "a" in FIG. 2, which provides the injection quantity QA when the injection period is the period τ0 and is parallel with the TQ-Q characteristic shown by the solid line "c". The injection quantity QE corresponds to the median QM of the predetermined range (an average of the lower threshold value MIN and the higher threshold value MAX). Then, the other actual injection quantities are obtained by performing the other learning injections based on the injection period τ2.

Through the control according to the third embodiment, the engine operating state characteristic value generated by the influence of the learning injection can be corrected.

(Fourth Embodiment)

Next, learning control according to a fourth embodiment of the present invention will be explained.

In the third embodiment, the provisional learning injection quantity (the injection period) is calculated so that the actual injection quantity (the influence value) substantially conforms to the median of the predetermined range only in the case where the actual injection quantity obtained in the early stage is out of the predetermined range. Then, the other actual injection quantities (the influence values) are obtained by performing the other learning injections based on the provisional learning injection quantity.

In contrast, in the fourth embodiment, the provisional learning injection quantity (the injection period) for substantially conforming the actual injection quantity (the influence value) to the median of the predetermined range is calculated even if the actual injection quantity (the influence value) obtained in the early stage is within the predetermined range. Then, the other actual injection quantities (the other influence values) are obtained by performing the other learning injections based on the provisional learning injection quantity.

More specifically, even in the case where the result of the determination in Step S10 of the first embodiment is "YES", if the actual injection quantity is the quantity QB, which is deviated from the learning master injection quantity QC as shown in FIG. 2, the injection quantities (the injection periods) of the other learning injections are changed to the provisional learning injection quantity (the injection period) for substantially conforming the actual injection quantity (the influence value) to the median of the predetermined range.

Next, a specific example of changing the injection quantity will be explained. In the case where the actual injection quantity Q is the quantity QB as shown in FIG. 2, an injection period τ5 is calculated from the injection quantity of the median QM of the predetermined range defined by the threshold values MIN, MAX, based on the TQ-Q characteristic shown by the broken line "b". The TQ-Q characteristic shown by the broken line "b" is parallel to the TQ-Q characteristic shown by the solid line "c" and provides the quantity QB when the injection period is the period τ0. Then, the other actual injection quantities (the other influence values) are obtained by performing the other learning injections based on the injection period τ5.

Through the control according to the fourth embodiment, the engine operating state characteristic value, which is generated by the influence of the learning injection, can be optimized.

(Fifth Embodiment)

Next, learning control according to a fifth embodiment of the present invention will be explained.

In the above embodiments, the system merely ends the control if the result of the determination in Step S3 is "NO", and passively waits until the learning condition is established.

In contrast, in the fifth embodiment, when the learning condition is not established, the operating state is positively brought to the learning condition in order to increase the frequency of the learning.

Figure 9:
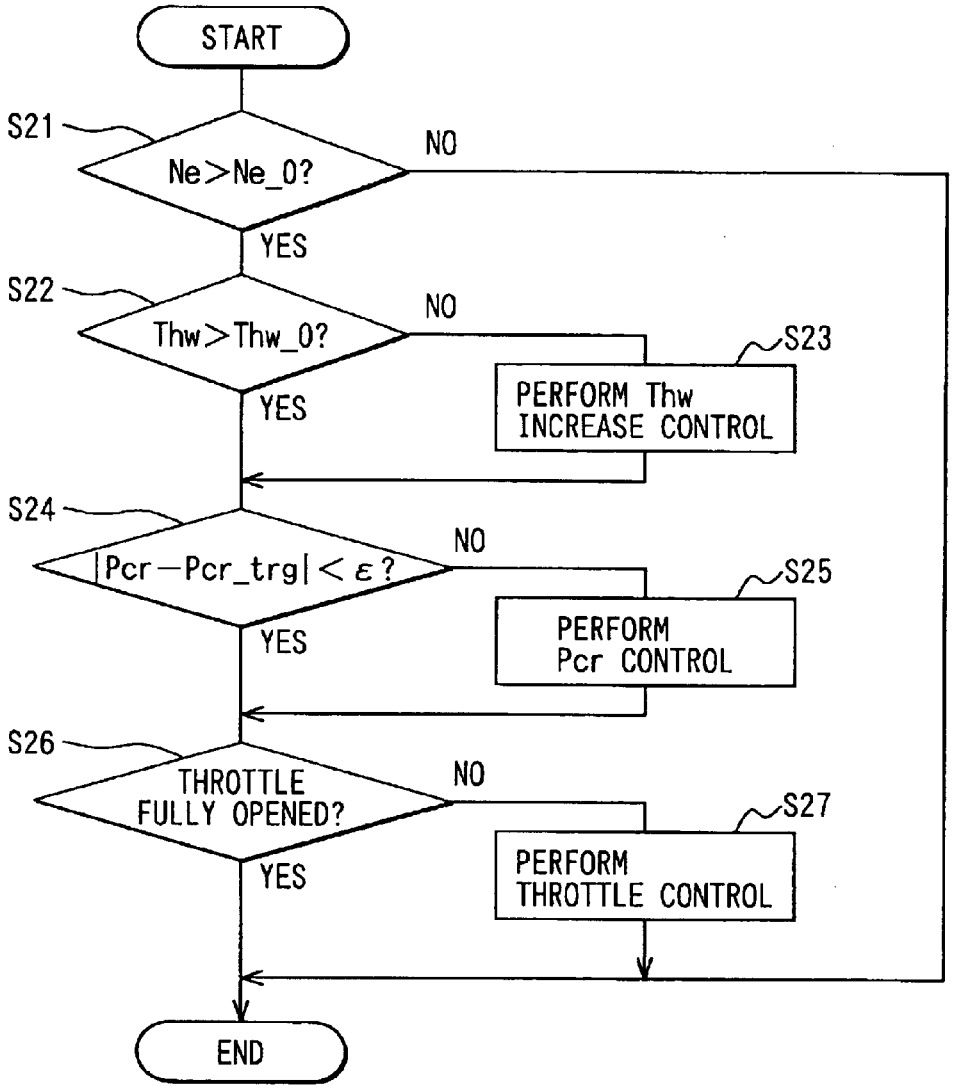
FIG. 9 is a flowchart showing control for establishing learning conditions according to a fifth embodiment of the present invention.

More specifically, in the fifth embodiment, if the result of the determination in Step S3 of the flowchart shown in FIG. 7 is "NO", control shown by a flowchart in FIG. 9 is performed.

First, in Step S21 of the flowchart shown in FIG. 9, it is determined whether the engine rotation speed Ne is higher than a predetermined rotation speed Ne_0. If the result of the determination in Step S21 is "NO", the routine is ended.

If the result of the determination in Step S21 is "YES", it is determined whether the engine cooling water temperature Thw is higher than a predetermined temperature Thw_0 in Step S22. If the result of the determination in Step S22 is "NO", control for increasing the engine cooling water temperature Thw is performed in Step S23.

If the result of the determination in Step S22 is "YES", or after the engine cooling water temperature increasing control in Step S23 is performed, it is determined whether the common rail pressure Pcr is within a predetermined pressure range with respect to a target common rail pressure Pcr_trg in Step S24. In FIG. 9, Pcr_trg represents the target common rail pressure at which the learning is performed and ε represents a threshold value of the common rail pressure Pcr.

If the result of the determination in Step S24 is "NO", control for bringing the common rail pressure Pcr into the predetermined pressure range is performed in Step S25. More specifically, in the case where the common rail pressure Pcr is lower than the predetermined pressure range, pressure increasing control is performed with the use of the supply pump 4. In the case where the common rail pressure Pcr is higher than the predetermined pressure range, pressure reducing control is performed by opening the pressure reducing valve, for instance.

If the result of the determination in Step S24 is "YES", or after the control in Step S25 is performed, it is determined whether the throttle disposed inside the air intake pipe is fully opened in Step S26. If the result of the determination in Step S26 is "YES", the routine is ended. If the result of the determination in Step S26 is "NO", control for fully opening the throttle is performed in Step S27, and the routine is ended.

In the fifth embodiment, the operating state is positively brought to the learning condition when the learning condition is not established. Thus, the frequency of the learning control can be increased. As a result, the frequency of the learning is increased and the injection accuracy can be improved.

(Modification)

In the above embodiments, the threshold values MIN, MAX of the learning injection quantity range are calculated during the learning control. Alternatively, the threshold values MIN, MAX may be stored in the memory device in advance in order to reduce a calculation load of the learning control.

In the above embodiments, the actual injection quantity is employed as an example of the influence value.

Alternatively, the learning value may be calculated by using another influence value such as a variation ΔNe in the engine rotation speed Ne, the generated torque T or an air-fuel ratio, which is influenced by the learning injection (an influence value having a tangible relationship with the actual injection quantity).

In the above embodiments, the learning master injection quantity (the injection period τ0) is employed as the learning injection quantity (the initial value) in the early stage of the obtainment of the influence values. Alternatively, the learning injection quantity in the early stage may be set within the predetermined range (the range defined by the threshold values MIN, MAX in the above embodiments) based on the learning value set in the previous time or the provisional learning injection quantity (the injection period) set in the previous time.

In the above embodiments, the influence value is obtained once in the early stage of the obtainment of the influence values. Alternatively, multiple influence values may be obtained in the early stage. In this case, the number of the influence values obtained in the early stage should preferably be set less than the number of the other obtained influence values. Thus, a ratio of presence of the undesirable engine operating state characteristic value due to the learning injection is reduced and a ratio of presence of the desirable engine operating state characteristic value can be increased.

Multiple learning injections may be performed in the early stage of the obtainment of the influence values, and the performance degradation of the injection system such as the injector 3 may be determined based on the multiple influence values. In this case, for instance, the learning injections are performed multiple times in the early stage of the obtainment of the influence values. Then, an average Tb of the multiple influence values (the generated torque values) and a variation β of the influence values with respect to the average Tb are calculated. If the variation β is greater than a predetermined value α, it is determined that the performance of the injection system is degraded largely. The original generated torque T0 is achieved when the actual injection quantity coincides with a command injection quantity (an injection quantity, which the injector is commanded to inject).

Alternatively, it may be determined that the performance of the injection system is degraded largely if the average Tb of the generated torque T is lower than the original generated torque T0 by at least a predetermined value δ or is greater than the original generated torque T0 by at least the predetermined value δ.

Moreover, it may be determined that the performance of the injection system is degraded largely if a maximum value among the multiple influence values is greater than a predetermined maximum value or if a minimum value among the multiple influence values is less than a predetermined minimum value.

In the above embodiments, the common rail type fuel injection system is employed as an example of the fuel injection system. Instead, the present invention may be applied to any other types of fuel injection systems such as a pressure accumulation type fuel injection system other than the common rail type fuel injection system, and a distribution type fuel injection system.

The present invention can be applied not only to the learning control of the diesel engine but also to the learning control of the other types of engines such as a gasoline engine.

The present invention should not be limited to the disclosed embodiments, but may be implemented in many other ways without departing from the spirit of the invention.

What is claimed is:

1. A fuel injection system including a control unit, which performs a learning injection based on a learning injection quantity and obtains multiple influence values of an operating state of an engine generated through the learning injection in order to calculate a learning value for correcting the injection quantity in a normal operation based on the obtained multiple influence values, wherein the control unit includes determining means for determining whether the influence value obtained during the learning injection is within a predetermined range of the influence value set in accordance with a characteristic value of the operating state of the engine, and the control unit calculates a provisional learning injection quantity for bringing subsequent influence values into the predetermined range when the influence value obtained in an early stage of the obtainment of the influence values is out of the predetermined range, and calculates the other influence values by performing the other learning injections based on the provisional learning injection quantity.

2. The fuel injection system as in claim 1, wherein the predetermined range is set in accordance with at least one of a quantity of exhaust emission from the engine, a level of engine noise and torque generated by the engine.

3. The fuel injection system as in claim 1, wherein the control unit obtains a smaller number of influence values in the early stage of the obtainment of the influence values than in a period after the early stage of the obtainment.

4. The fuel injection system as in claim 1, wherein the control unit calculates the provisional learning injection quantity for substantially conforming the actual injection quantity to a predetermined learning master injection quantity in accordance with the influence value obtained in the early stage of the obtainment of the influence values.

5. The fuel injection system as in claim 1, wherein the control unit calculates the provisional learning injection quantity for substantially conforming the actual injection quantity to a median of the predetermined range in accordance with the influence value obtained in the early stage of the obtainment of the influence values.

6. The fuel injection system as in claim 1, wherein the control unit calculates the learning value of each cylinder of the engine individually.

7. A fuel injection system including a control unit, which performs a learning injection based on a learning injection quantity and obtains multiple influence values of an operating state of an engine generated through the learning injection in order to calculate a learning value for correcting the injection quantity in a normal operation based on the obtained multiple influence values, wherein the control unit changes the learning injection quantity so that a characteristic value of the operating state of the engine falls within a predetermined range if the characteristic value is out of the predetermined range, the characteristic value being set in accordance with at least one of a quantity of exhaust emission from the engine, a level of engine noise and torque generated by the engine, which are generated through the learning injection.

* * * * *